US011370018B2

(12) United States Patent
Mabuchi

(10) Patent No.: US 11,370,018 B2
(45) Date of Patent: Jun. 28, 2022

(54) ELECTRIC WIRE STRAIGHTENING DEVICE

(71) Applicant: Yazaki Corporation, Tokyo (JP)

(72) Inventor: Miyoshi Mabuchi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 330 days.

(21) Appl. No.: 16/048,529

(22) Filed: Jul. 30, 2018

(65) Prior Publication Data

US 2019/0039117 A1 Feb. 7, 2019

(30) Foreign Application Priority Data

Aug. 4, 2017 (JP) ..... JP2017-151518

(51) Int. Cl.
*B21F 1/02* (2006.01)

(52) U.S. Cl.
CPC ..... *B21F 1/023* (2013.01)

(58) Field of Classification Search
CPC .. B21F 1/023; B21F 1/026; B21F 1/02; B21F 23/00; B21F 11/00; B21D 3/05; B05D 3/12; B05D 7/20; B65G 49/00
See application file for complete search history.

(56) References Cited

U.S. PATENT DOCUMENTS 2,752,956 A * 7/1956 Hampson ..... B21F 1/00 140/71 R
3,227,682 A * 1/1966 Hornbaker ..... C08G 63/195 528/305
3,264,855 A * 8/1966 Turbett ..... B21F 1/023 72/79
3,543,810 A * 12/1970 Scheller ..... B21F 1/023 140/147
4,047,418 A * 9/1977 Fangmeier ..... B21C 19/00 72/278
4,177,843 A * 12/1979 Sarver ..... B21F 1/023 140/147
4,261,396 A * 4/1981 Perrenoud ..... B21F 1/02 140/147

(Continued)

FOREIGN PATENT DOCUMENTS

CN 205851739 U 1/2017
EP 0 621 095 A1 10/1994

(Continued)

*Primary Examiner* — Adam J Eiseman
*Assistant Examiner* — Fred C Hammers
(74) *Attorney, Agent, or Firm* — Sughrue Mion, PLLC

(57) ABSTRACT

Provided is an electric wire straightening device capable of correcting a twist generated around an axis of an electric wire. An electric wire correcting device includes an electric wire holding part provided rotatably around an axis of the electric wire for holding an electric wire having been withdrawn from an electric wire reel so as to further withdraw the electric wire toward a side opposite to the electric wire reel and, a rotation driving part rotating the electric wire holding part in an twist backing direction opposite to a twist around an axis of the electric wire occurring in the electric wire between the electric wire reel and the electric wire holding part by further withdrawing the electric wire from the electric wire holding part.

5 Claims, 3 Drawing Sheets

(56) References Cited

U.S. PATENT DOCUMENTS

| | | | | | |
|---|---|---|---|---|---|
| 4,391,307 | A * | 7/1983 | Levi | B21F 1/026 | 140/140 |
| 4,799,373 | A * | 1/1989 | Benton | B21D 7/022 | 72/216 |
| 4,920,776 | A * | 5/1990 | Denzler | B21F 1/023 | 72/79 |
| 5,427,295 | A * | 6/1995 | David | B23K 9/1336 | 226/180 |
| 5,442,946 | A * | 8/1995 | Yokoo | B21F 1/02 | 72/235 |
| 5,473,923 | A | 12/1995 | Hochspach et al. | | |
| 5,904,059 | A * | 5/1999 | Perna | B21F 1/023 | 140/147 |
| 2008/0314473 | A1* | 12/2008 | Ishibashi | B65H 63/061 | 140/140 |
| 2011/0240169 | A1* | 10/2011 | Leibfritz | G01P 3/366 | 140/140 |
| 2012/0171382 | A1* | 7/2012 | Mullin | B65H 57/12 | 427/294 |
| 2016/0354820 | A1* | 12/2016 | Katou | B21F 1/02 | |

FOREIGN PATENT DOCUMENTS

| | | | |
|---|---|---|---|
| JP | 53-99065 | A | 8/1978 |
| JP | H08-267163 | A | 10/1996 |
| JP | 2003-94138 | A | 4/2003 |
| JP | 2015-225692 | A | 12/2015 |
| JP | 2016-225093 | A | 12/2016 |

* cited by examiner

ELECTRIC WIRE STRAIGHTENING DEVICE

TECHNICAL FIELD

The present invention relates to an electric wire straightening device for correcting a twist generated around an electric wire axis.

BACKGROUND ART

For example, when manufacturing a wire harness and the like, electric wires are withdrawn from an accommodation place such as electric reel by a desired length (see, for example, Patent Document 1). In the technique described above, the electric wire is passed between a plurality of staggered rollers, so that bending and the like of the electric wire are corrected.

[Patent Document]

Patent Document 1: Japanese Unexamined Patent Application Publication No. 2015-225692

DISCLOSURE OF THE INVENTION

Problems to be Solved by the Invention

Here, for example, when withdrawing an electric wire from an accommodation place accommodating the electric wire in a state of being wound like electric wire reel and the like, twist may occur around an axis of the electric wire depending on the way of withdrawing out. The technique described in Patent Document 1 may not completely correct such twist.

Accordingly, the present invention focuses on the above-mentioned problem, and is to provide an electric wire straightening device capable of correcting twist generated around the axis of the electric wire.

Means for Solving the Problems

In order to solve the above problem, it is characterized that an electric wire straightening device includes: an electric wire holding part provided rotatably around an axis of an electric wire for holding the electric wire having been withdrawn from a predetermined accommodation place so as to further withdraw the electric wire toward a side opposite to the accommodation place and; a rotation driving part for rotating the electric wire holding part in an twisting back direction opposite to a twist around an axis of the electric wire occurring in the electric wire between the accommodation place and the electric wire holding part by further withdrawing the electric wire from the electric wire holding part.

Advantageous of the Invention

In the electric wire straightening device of the present invention, since the electric wire holding part is provided rotatably around the axis of the electric wire to be held, the electric wire holding part rotates in the twist back direction opposite to the direction of twist around the axis of the electric wire. This rotation of the wire holding part allows the twist around the axis of the electric wire to be corrected.

MODE OF CARRYING OUT THE INVENTION

Hereinafter, one embodiment of the present invention will be described.

Figure 1:
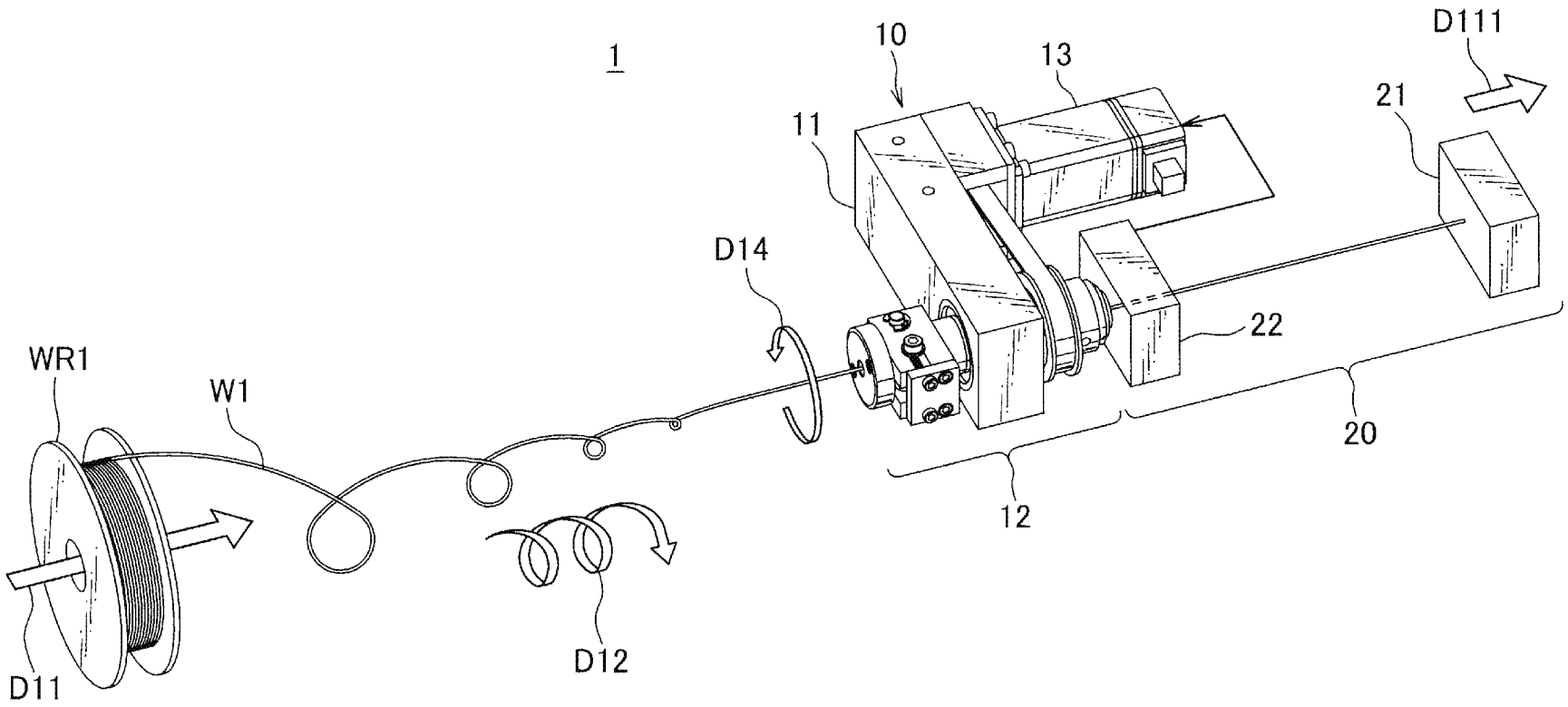
FIG. 1 is a schematic view showing an example of an electric wire cutting system to which an embodiment of the present invention is applied.
Figure 2:
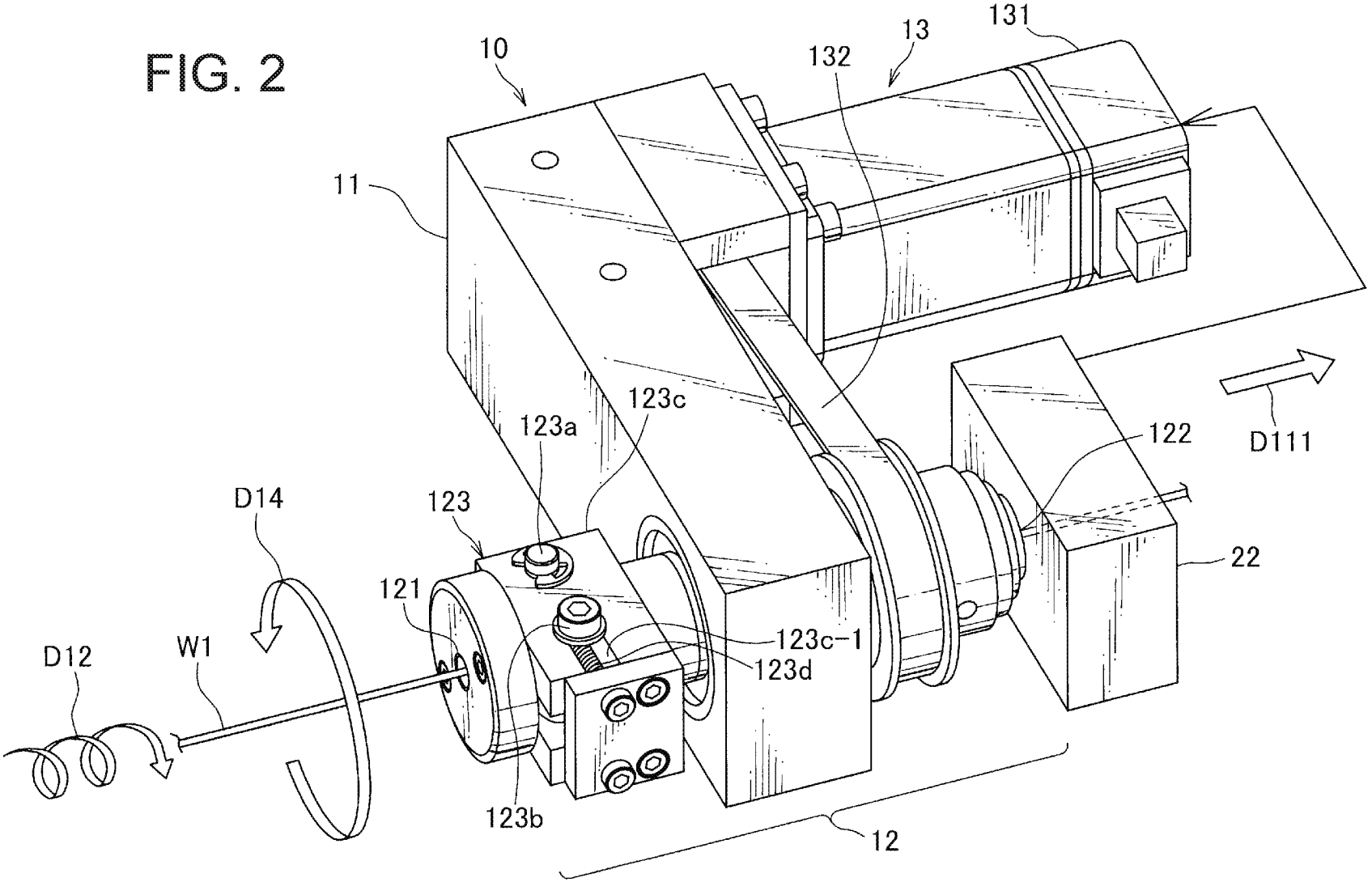
FIG. 2 is a view showing an electric wire straightening device included in the electric wire cutting system shown in FIG. 1.

FIG. 1 is a schematic diagram showing an example of a wire cutting system to which an embodiment of the present invention is applied, and FIG. 2 is a view showing an electric wire straightening device included in the electric wire cutting system shown in FIG. 1.

The electric wire cutting system 1 shown in FIG. 1 is to withdraw from an electric wire reel WR1 as an electric wire accommodation place and cut, an electric wire reels WR1, and is provided with an electric wire straightening device 10, a scale cutter 20.

In the present embodiment, the electric wire W1 is withdrawn from the electric wire reel WR1 along a center axis direction D11 of the electric wire reel W1. At this time, the electric wire W1 experiences twist in a twist direction D12 of the electric wire reel WR1. The electric wire straightening device 10 is to correct the twist of the electric wire W1 just in front of preceding scale cutter 20. This electric wire straightening device 10 will be described later in detail.

The scale cutter 20 is an apparatus for withdrawing from the electric wire straightening device 10 and cutting the electric wire W1. The scale cutter 20 is provided with an electric wire pulling part 21 and a scale cutting part 22. The electric wire pulling part 21 is a part for holding and pulling an end portion of the electric wire W1 in a withdrawal direction D111 from the electric wire straightening device 10 so as to pull out the electric wire W1. The scale cutting part 22 is a part, while measuring the withdrawal length of the electric wire W1, cutting the electric wire W1 when the measurement result reaches a preset target withdrawal length.

FIG. 1 shows that the central axis direction D11 of the electric wire reel WR1, that is, a withdrawal direction of the electric wire withdrawn from the electric wire reel WR1, and a withdrawal direction D111 withdrawn from the electric wire straightening device 10 coincide, simplifying the drawings. However, the electric wire cutting system 1 may be configured such that the electric wire W1 withdrawn out along the direction D11 from the electric wire reel WR1, while changing direction on the way, thereafter reaches the electric wire straightening device 10. In such a case, differing from a configuration shown in FIG. 1, the withdrawal direction D111 from the wire straightening device 10 may not necessarily coincide with the center axis direction D11 of the electric wire reel WR1.

As described above, the electric wire straightening device 10 is a device for correcting the twist of the electric wire W1 withdrawn out from the electric wire reel WR1, includes a support frame 11, an electric wire holding part 12, and a rotation driving portion 13.

The support frame 11 is a rectangular parallelepiped portion fixed to a not-shown device frame, and the wire holding part 12 is rotatably supported on one end side thereof, and the rotation driving portion 13 is fixed to the other end side.

The electric wire holding part 12 holds the electric wire W1 withdrawn out from the electric wire reel WR1 so as to be further pulled out to the opposite side of the wire reel WR1 by the electric wire pulling part 21 of the scale cutter 20. The electric wire holding part 12 is formed in a substantially cylindrical shape, and the electric wire W1 is held so as to pass through a center of the electric wire holding part 12 and is pulled out in the withdrawal direction D111 by the electric wire pulling part 21. Then, the electric wire holding part 12 is rotatably held by the supporting frame 11 about the axis of the electric wire W1 passing through the center thereof. Further, an inlet port 121 for the wire W1 is provided at an end on the side of the wire reel WR1 of the wire holding part 12 and an outlet port 122 is provided at the other end portion. On the downstream side of the wire holding part 12 in the withdrawal direction D111, a scale cutting part 22 of the scale cutter 20 is arranged.

In this wire holding part 12, a holding mechanism 123 for the electric wire W1 is provided on the downstream side of the inlet 121 in the withdrawal direction D111.

Figure 3:
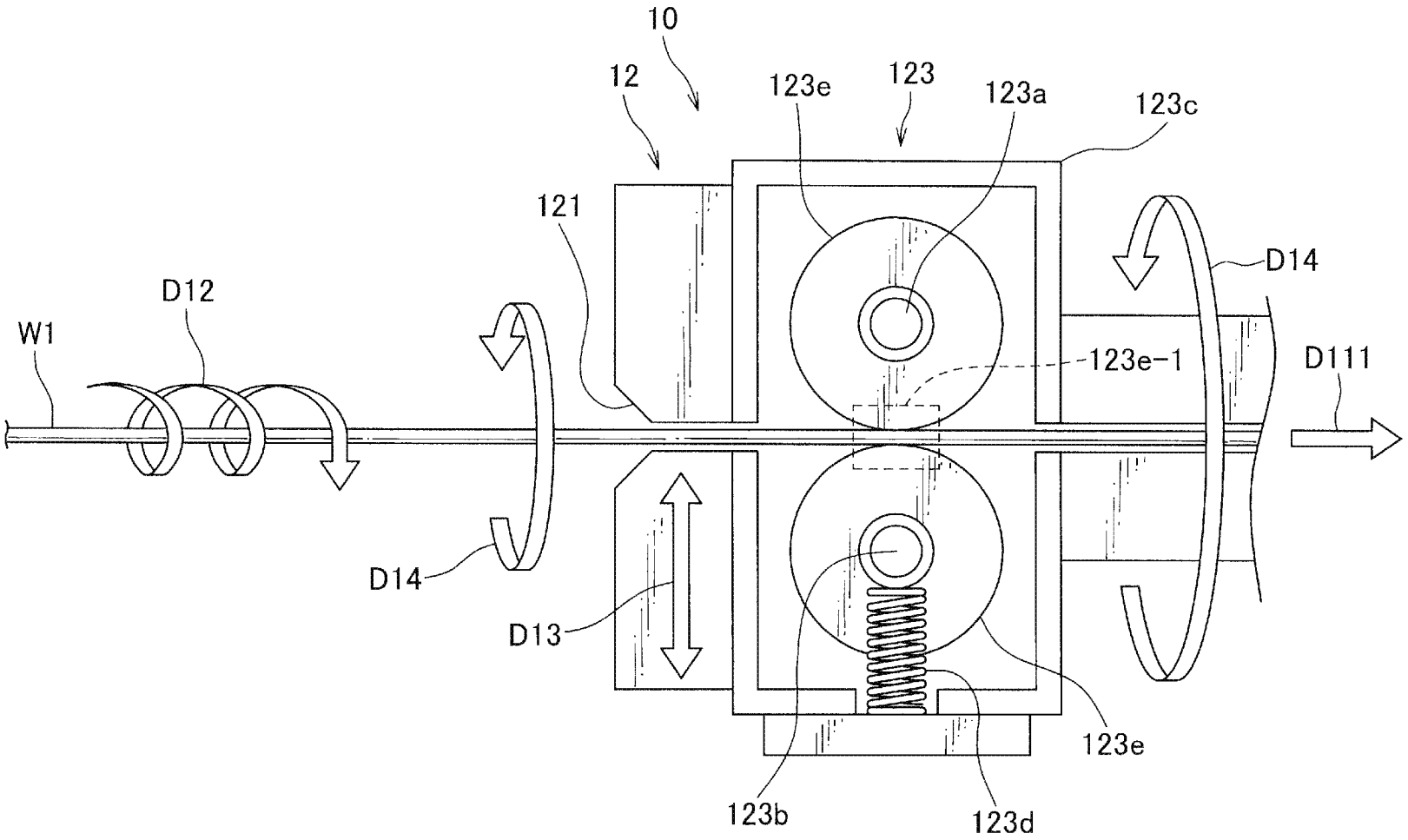
FIG. 3 is a schematic view showing an internal structure of a holding mechanism in an electric wire holding part shown in FIG. 2.

FIG. 3 is a schematic view showing an internal structure of the holding mechanism in the wire holding part shown in FIG. 2.

Inside the holding mechanism 123, there is provided a fixed rotation shaft 123*a* and a movable rotation shaft 123*b* crossing the withdrawal direction D111. The fixed rotation shaft 123*a* is fixed to a case 123*c* of the holding mechanism 123, and the movable rotation shaft 123 *b* is fixed to the case 123*c* movably along a guide slit 123*c*-1 provided in the case 123*c*. The guide slit 123*c*-1 is provided guiding the movable rotation shaft 123*b* in a contact/separation direction D13 with respect to the fixed rotation shaft 123*a*. Further, the movable rotation shaft 123*b* is biased toward the fixed rotation shaft 123*a* by a spring 123*d* provided in the case 123*c*. And around the fixed rotation shaft 123*a* and the movable rotation shaft 123*b* a pair of electric wire clamping rollers 123*e* are rotatably attached. As the spring 123*d* urges the movable rotation shaft 123*b* as described above, the outer periphery of the wire clamping roller 123*e* of the movable rotation shaft 123*b* is pressed against the outer periphery of the wire clamping roller 123*e* of the fixed rotation shaft 123*a*.

The electric wire W1 taken in from the inlet 121 passes through between the outer peripheries of the pair of wire clamping rollers 123 *e*, so that it can be clamped between the outer peripheries of the pair of wire clamping rollers 123*e*. Since the pair of wire clamping rollers 123*e* is rotatable, the electric wire W1 is clamped in a withdrawable manner in the withdrawal direction D111. Further, in the present embodiment, the inlet 121 is formed into a wide mouth shape spreading from the inside to the outside. Then, inlet 121 is provided so that the center thereof is positioned on the central axis of the cylindrical electric wire holding part 10, and a clamping region 123*e*-1 of the electric wire W1 by the pair of electric wire clamping rollers 123*e* is also positioned on the central axis of the electric wire holding part 10. That is, in the present embodiment, the electric wire W1 is configured to be held on the axis passing through the center of the inlet 121.

In the electric wire straightening device 10 shown in FIGS. 1 and 2, as described above, the electric wire holding part 12 holding the electric wire W1 is configured to be rotated by the rotation driving portion 13. The rotation driving part 13 includes a servomotor 131 as a drive source and a drive belt 132 as a power transmission mechanism. The drive belt 132 is bridged between an output shaft of the servomotor 131 and a part protruding from the support frame 11 to the scale cutting part 22 of the scale cutter 20 in the electric wire holding part 12. Rotation of the output shaft of the servomotor 131 is transmitted to the electric wire holding part 12 by the drive belt 132, and the electric wire holding part 12 rotates.

At this time, although the rotation of the servomotor 131 is controlled by a control circuit (not shown), the servomotor 131, under the control, rotates the electric wire holding part 12 in the following direction. That is, the servomotor 131 rotates so as to rotate the wire holding part 12 in the twisting back direction D14 opposite to the twist around the axis of the electric wire W1 occurring in the electric wire W1 from the electric wire reel WR up to the electric wire holding part 12 by further pulling out from the electric wire holding part 12.

As described above, when the electric wire W1 is pulled out from the electric wire reel WR1, twist occurs in the winding direction D12 of the electric wire W1 in the electric wire reel WR1 around the axis the electric wire W1. The above-mentioned twisting back direction D14 which is the rotation direction of the wire holding part 12 is an opposite direction to the winding direction D12 of the electric wire W1.

Here, in the scale cutting part 22 of the scale cutter 20, as described above, the target withdrawal length is set in advance at the time of the electric wire W 1 being pulled out to cut. This setting is set by an operational input by an operator, but in the present embodiment, the target withdrawal length, which is the set value at this time, is notified from the scale cutting part 22 of the scale cutter 20 to the rotation driving part 13. In the rotation driving part 13, the control circuit of the servomotor 131 acquires the target withdrawal length via this notification, and controls the servomotor 131 so as to rotate the wire holding part 12 at a number of rotations based on this target withdrawal length.

When the electric wire W 1 is pulled out from the electric wire reel WR1, every time the wire W1 is pulled out for one turn of the electric wire reel WR1, the electric wire W1 becomes twisted around the axis once. That is, how many twists are produced on the wire W1 when the wire W1 is pulled out depends on the withdrawal length of the wire W1.

In the present embodiment, at an initial stage where a distal end of the electric wire W1 withdrawn out from the electric wire reel WR1 is passed through the electric wire holding section 12 of the electric wire straightening device 10 and the scale cutting part 22 of the scale cutter 20, and is set to the wire withdrawing part 21, the operator pulls out the electric wire W1 while correcting the twist. In this initial stage, the twist hardly occurs in the electric wire W1 from the electric wire reel WR1 to the electric wire holding part 12.

Thereafter, in the scale cutter 20, though withdrawal by the target withdrawal length from the wire holding part 12 and cutting are repeatedly performed, but each time the withdrawal by the scale cutter 20 occurs once, new twist corresponding to the target withdrawal length occurs in the electric wire W1 between the electric wire reel WR1 and the electric wire holding part 12. As described above, how many twists occur in the electric wire W1 depends on the withdrawal length of the electric wire W1. In the present embodiment, every time the withdrawal by the scale cutter 20 occurs once, rotating the electric wire holding part 12 at the number of rotations based on the target withdrawal length corresponding to one time withdrawal length corrects the twist of the electric wire corresponding to one time withdrawal length.

Here, how the servomotor 131 is controlled by the control circuit for rotating the electric wire holding part 12 in this way, although not specified in the present embodiment, may be one of the following three types of control.

First, the first control that can be performed by the control circuit of the servomotor 131 in the rotation driving part 13 will be explained. The first control, based on the target withdrawal length at the time of withdrawing and cutting at the previous time, the twist of the electric wire W1 at the previous time is corrected before twisting and cutting are performed at the present time. In this first control, the control circuit of the servomotor 131 obtains the target withdrawal length when the disconnection has been made from the scale cutter 20 at the previous time. Then, before performing scale and cutting at the present time the control circuit controls the rotation of the servomotor 131 so as to rotate the electric wire holding part 12 based on the target withdrawal length. According to this first control, the withdrawal and cutting of the electric wire W1 by the scale cutter 20 starts every time in a condition that the electric wire W 1 is not twisted, and the twist corresponding to one target withdrawal length occurs at a state where withdrawal and cutting for one time is completed. The twist is corrected before withdrawal and cutting at next time.

Next, a second control will be described. The second control is that before the withdrawal and cutting is performed at the present time, anticipating the twist occurring in the electric wire W1 at the present time, before this withdrawal and cutting is performed at the present time, the electric wire W1 is preliminarily twisted in the opposite direction to the twist to occur at the present time at the number of rotations based on the target withdrawal length. In this second control, the control circuit of the servomotor 131 preliminarily obtains the target withdrawal length at the present time from the scale cutter 20. Then, before the withdrawal and cutting is performed at the present time, the control circuit controls the rotation of the servomotor 131 to rotate the electric wire holding part 12 at the number of rotations based on the target withdrawal length. According to this second control, withdrawal and cutting of the electric wire W1 by the scale cutter 20 starts in a state in which the electric wire W1 is twisted in the reverse direction in advance, and withdrawer and cutting by one time is performed so as to correct the preliminary twist. Then, when withdrawal and cutting is completed, the electric wire W1 is in a state where there is no twist.

Next, the third control will be described. The third control performs every time withdrawal and cutting while twisting the electric wire W1 in a direction opposite to the twist occurring at the time at the number of rotations based on the target withdrawal length. Also in this third control, the control circuit of the servomotor 131 obtains the target withdrawal length of the present time in advance from the scale cutter 20. Then, the control circuit starts withdrawing the electric wire W1 and rotates the electric wire holding part 12, and controls the rotation of the servomotor 131 so that the number of rotations till the electric wire W1 is withdrawn out to the target withdrawal length is equal to the number of rotations based on the current target withdrawal length. According to this third control, withdrawal and cutting of the electric wire W1 by the scale cutter 20 starts in a state in which no twist occurs in the electric wire W1, and one withdrawal and cutting is carried out while correcting the twist during the process. Therefore, there is no twist in the electric wire W1 even at a stage that withdrawal and cutting is completed.

In the electric wire straightening device 10 of the present embodiment described above, the wire holding part 12 is provided rotatably around the axis of the supporting electric wire W1, and by the function of the rotation driving part 13 the wire holding part 12 rotates in the twisting back direction D14 opposite to twisting direction about the axis of the wire holding part 12. This rotation of the electric wire holding part 12 can correct the twist around the axis of the electric wire W1.

Further, in the present embodiment, since the electric wire W1 is configured to be withdrawn along the central axis direction D11 of the electric wire reel WR1, the electric wire reel WR1, that tends to be heavy to rotate, can be withdrawn without substantially rotating.

Here, as a configuration for withdrawing out the electric wire W1 from the electric wire reel WR1, unlike the present embodiment, for example, the electric wire W1 is withdrawn out in the tangential direction of the outer periphery of the electric wire reel WR1, and supports the electric wire reel WR1 so as to be able to rotate in accordance with the rotation. However, because the configuration for rotatably supporting the electric wire reel WR1 that tends to be heavy to rotate as described above is cumbersome, the facility cost may increase in such a configuration. Furthermore, in the case of constructing a system that withdraws from the electric wire reel WR1 and cuts the electric wire W1, there is a risk of further increasing the equipment cost in the configuration in which the electric wire reel WR1 is rotatably supported.

On the other hand, in this embodiment in which the wire W1 can be pulled out without substantially rotating the wire reel WR1, since the electric wire reel WR1 needs only be placed on the installation place, the facility cost can be reduced. On the other hand, when the electric wire W1 is pulled out along the central axis direction D11 of the electric wire reel WR1, at the time of withdrawing out, the twist occurs along the winding direction D12 of the electric wire W1 on the reel WR1 around the axis of the electric wire W1. According to the electric wire straightening device 10 in this embodiment, the wire holding part 12 rotates in the direction opposite to the winding direction D12 as the twisting back direction D14, so as to correct the twist of the electric wire W1 in the configuration capable of reducing the equipment cost as described above.

Further, in the present embodiment, the rotation driving part 13 is configured to receive the target withdrawal length from the scale cutter 20, and rotate the electric wire holding part 12 at the number of rotations based on the target withdrawal length. As described above, the twist occurred about the axis by the withdrawing of the electric wire W1 depends on the withdrawal length of the electric wire W1. According to the electric wire straightening device 10 of the present embodiment, the electric wire holding part 12 rotates at the number of rotations based on the withdrawal target length withdrawn by the scale cutter 20, correcting the twist of the electric wire with a high degree of accuracy while also suppressing an over twist back and the like.

In addition, in the above-described first control, before withdrawing and cutting is performed in the present time by the scale cutter 20, the rotation driving part 13 rotates the electric wire holding part 12 at the number of rotations based on the previous target withdrawal length. As a result, the twist caused at the time of the previous withdrawing is canceled and withdrawing and cutting of the current wire W1 at the present time is performed, and the twist of the electric wire W 1 can be corrected with higher accuracy.

In addition, in the second control and the third control described above, before or while the current target withdrawal length is acquired in advance, the rotation driving part 13 rotates the electric wire holding part 12 at the number of rotations based on the target withdrawal length. With this case, in anticipation of the twist occurring in this withdrawal, it is performed to preliminarily produce opposite twist, or to withdraw while correcting the twist, it is possible to correct the twist of the electric wire with higher accuracy.

Further, according to the present embodiment, by clamping the electric wire W1 between the pair of wire clamping rollers 123*e*, the electric wire W1 can be stably retained and straightened in a state where the electric wire W1 can be pulled out.

Further, in the present embodiment, the inlet 121 of the wire W1 is formed in the wide mouth shape as described above, the holding area 123*e*-1 held by the pair of electric wire clamping rollers 123*e* is positioned on the axis passing through the center thereof. Here, as shown in FIG. 1, when the distance between the wire reel WR1 and the wire straightening device 10 is short, the electric wire W1 pulled out from the electric wire reel WR1 may be taken into the inlet 121 from an oblique direction deviated from the axis passing through the center of the inlet 121. However, according to the present embodiment, even in such a case, the electric wire W1 is guided to the holding area 123*e*-1 on the axis passing through the center thereof by the wide mouth shaped inlet 121. As a result, the electric wire W1 from the deviated direction as described above is stably held and corrected.

It is to be noted that the above-described embodiment merely shows a representative form of the present invention, and the present invention is not limited to this embodiment. That is, various deformations within a range not deviating from the gist of the present invention can be carried out. The configuration, as long as the electric wire straightening device of the present invention also is provided, is of course included in the scope of the present invention.

For example, in the above-described embodiment, the electric wire reel WR1 is exemplified as an example of the accommodating place referred to in the present invention. However, the accommodating place referred to in the present invention is not limited to this. The accommodating place referred to in the invention is, for example, only a place where electric wires wound in a ring shape are placed, and as long as a place is accommodated in a state in which the twist around the axis occurs in the electric wire when the electric wire is pulled out, no specific aspect is required.

In the above-described embodiment, as an example of the electric wire straightening device according to the present invention, a substantially cylindrical electric wire holding part 12 is rotatably supported at the one end portion of the rectangular parallelepiped holding frame 11, and the electric wire straightening device 10 to which the rolling driving part 13 is fixed is illustrated at the other end portion. However, the electric wire straightening device referred to in the present invention is not limited to this. The electric wire straightening device according to the present invention can, if provided with the electric wire holding part rotatably provided and the rotation driving part for rotating the electric wire holding part, is arbitrarily set in the shape of each part or the frame structure and the like.

Further, in the above-described embodiment, as an example of the rotation driving part according to the present invention, the rotation driving part 1 having the servomotor 131 as the power source and the drive belt 132 as the power transmission mechanism are exemplified. However, the rotation driving part according to the present invention is not limited to this. The rotation driving part according to the present invention may include a motor or the like other than the servomotor as the driving source or may be provided with a gear mechanism or the like other than the drive belt as the power transmission mechanism.

Further, in the above-described embodiment, as an example of the electric wire holding part according to the present invention, the electric wire holding part 12 for holding the electric wire W1 with the pair of electric wire clamping roller 123*e* is exemplified. However, the electric wire holding part according to the present invention is not limited to this. The electric wire holding part according to the present invention is not limited to the specific holding structure of the electric wire if holding the electric wire in a state of withdrawal, for example, clamping the electric wire between a plurality of rotating rollers or the like. However, by arranging the electric wire W1 to be clamped by the pair electric wire clamping roller 123*e*, the electric wire W1 can be stably held as stated above, in a state possible to be pulled out.

DESCRIPTION OF SYMBOLS

1 electric wire cutting system
10 electric wire straightening device
11 support frame
12 electric wire holding part
13 rotation driving part
20 scale cutter
21 electric wire pulling part
22 scale cutting section
121 inlet
122 outlet
123 holding mechanism
123*a* fixed rotation axis
123*b* movable rotation shaft
123*c* case
123*c*-1 guide slit
123*d* spring
123*e* wire clamping roller
123*e*-1 clamping area
131 servomotor
132 driving belt
D11 center axis direction
D12 winding direction
D13 contact direction
D14 twist back direction
D111 withdrawal direction
W1 electric wire
WR1 electric wire reel

The invention claimed is:

1. An electric wire straightening device comprising:

an electric wire holding part holding an electric wire having been withdrawn from a non-rotating electric wire reel as a predetermined accommodation place along a central axis direction of the non-rotating electric wire reel but allowing the electric wire to be withdrawn from the predetermined accommodation place, the electric wire holding part being provided rotatably together with the held electric wire around an axis of the held electric wire; and a rotation driving part rotating the electric wire holding part and the held electric wire by at least 360° in an untwist direction reverse to a twist direction around the axis of the held electric wire, wherein a twist in the twist direction occurs in the held electric wire between the accommodation place and the electric wire holding part while the electric wire is being withdrawn from the non-rotating electric wire reel, wherein the rotation driving part rotates the electric wire holding part holding the held electric wire while the wire is being withdrawn from the non-rotating electric wire reel in a direction, as the untwist direction, reverse to a winding direction of the electric wire in the non-rotating electric wire reel, wherein the electric wire holding part is provided with a first roller that is rotatable around a first rotation shaft and a second roller that is rotatable around a second rotation shaft, the first rotation shaft and the second rotation shaft being in a plane orthogonal to a withdrawal direction of the electric wire withdrawn from the electric wire holding part and in parallel to each other, wherein the second rotation shaft is provided separably from the first rotation shaft and biased toward the first rotation shaft, so that an outer periphery of the second roller is provided to be pressed against an outer periphery of the first roller, wherein the first and second rollers are configured to clamp the held electric wire between the outer peripheries of the first and second rollers, and wherein the first and second rollers are further configured to rotate in the untwist direction reverse to the winding direction of the held electric wire while clamping the held electric wire to straighten the held electric wire.

2. An electric wire straightening device comprising:

an electric wire holding part holding an electric wire having been withdrawn from a non-rotating electric wire reel as a predetermined accommodation place along a central axis direction of the non-rotating electric wire reel but allowing the electric wire to be withdrawn from the predetermined accommodation place, the electric wire holding part being provided rotatably together with the held electric wire around an axis of the held electric wire;

a rotation driving part rotating the electric wire holding part and the held electric wire in an untwist direction reverse to a twist direction around the axis of the held electric wire, and a control circuit configured to control the rotating of the rotation driving part, wherein a twist in the twist direction occurs in the held electric wire between the accommodation place and the electric wire holding part while the electric wire is being withdrawn from the non-rotating electric wire reel, wherein the rotation driving part rotates the electric wire holding part holding the held electric wire while the wire is being withdrawn from the non-rotating electric wire reel in a direction, as the untwist direction, reverse to a winding direction of the electric wire in the non-rotating electric wire reel, wherein the electric wire holding part is provided with a first roller that is rotatable around a first rotation shaft and a second roller that is rotatable around a second rotation shaft, the first rotation shaft and the second rotation shaft being in a plane orthogonal to a withdrawal direction of the electric wire withdrawn from the electric wire holding part and in parallel to each other, wherein the second rotation shaft is provided separably from the first rotation shaft and biased toward the first rotation shaft, so that an outer periphery of the second roller is provided to be pressed against an outer periphery of the first roller, wherein the first and second rollers are configured to clamp the held electric wire between the outer peripheries of the first and second rollers, wherein the first and second rollers are further configured to rotate in the untwist direction reverse to the winding direction of the held electric wire while clamping the held electric wire to straighten the held electric wire wherein a scale cutter withdrawing out the electric wire while measuring a withdrawal length from the electric wire holding part is disposed on a downstream side of the electric wire holding part in the withdrawal direction, and cutting the electric wire when the withdrawal length reaches a target withdrawal length, and wherein the control circuit acquires the target withdrawal length from an input from an operator, and controls the rotation driving part to rotate the electric wire holding part at a specified number of rotations based on the target withdrawal length.

3. The electric wire straightening device according to claim 2, wherein the scale cutter repeatedly executes withdrawing from the electric wire holding part and cutting, and wherein the rotation driving part acquires the target withdrawal length when withdrawing and cutting were executed by the scale cutter at a previous time, and before withdrawing and cutting is executed by the scale cutter at a present time, rotates the electric wire holding part at the number of rotations based on the target withdrawal length.

4. The electric wire straightening device according to claim 2, wherein the scale cutter repeatedly executes withdrawing from the electric wire holding part and cutting, and wherein the rotation driving part preliminarily acquires the target withdrawal length for performing withdrawing and cutting executed by the scale cutter in present time, and before or while withdrawing, rotates the electric wire holding part at the number of rotations based on the target withdrawal length.

5. The electric wire straightening device according to claim 1, wherein an inlet port of the electric wire holding part provided on a side of the accommodation place is formed into a wide mouth shape spreading outwardly in the electric wire holding part, and the electric wire is held on an axis passing through a center of the inlet.

* * * * *